US006941608B1

(12) United States Patent
Morad et al.

(10) Patent No.: US 6,941,608 B1
(45) Date of Patent: Sep. 13, 2005

(54) COLLAR TO BE USED WITH A DECK MOP TO RETAIN YARN AND CONNECT TO THE HANDLE

(75) Inventors: Fred I. Morad, Toluca Lake, CA (US); James G. Horian, Newport Beach, CA (US)

(73) Assignees: Worldwide Integrated Resources, Inc., Commerce, CA (US), part interest; Metro Bay Products, Inc., Costa Mesa, CA (US), part interest ( * ) Notice: Subject to any disclaimer, the term of this patent is extended or adjusted under 35 U.S.C. 154(b) by 387 days.

(21) Appl. No.: 10/366,989

(22) Filed: Feb. 13, 2003

(51) Int. Cl.[7] ..... A47L 13/24
(52) U.S. Cl. ..... 15/228; 15/145; 15/229.1; 15/229.2

(58) Field of Search ..... 15/145, 147.1, 15/229.1, 228, 228.02, 118, 119.1, 115

(56) References Cited

U.S. PATENT DOCUMENTS 3,152,350 A * 10/1964 Vosbikian ..... 15/229.1
4,417,364 A * 11/1983 Hammond ..... 15/147.1

* cited by examiner

*Primary Examiner*—John Kim
*Assistant Examiner*—Abraham Bahta
(74) *Attorney, Agent, or Firm*—Thomas I. Rozsa; Tony D. Chen

(57) ABSTRACT

A novel, new and improved attachment collar for a deck mop, by which mop yarn can be quickly and efficiently attached together and by which the collar can be quickly and efficiently attached to a handle.

30 Claims, 4 Drawing Sheets

COLLAR TO BE USED WITH A DECK MOP TO RETAIN YARN AND CONNECT TO THE HANDLE

BACKGROUND OF THE INVENTION

1. Field of the Invention

The present invention relates to the field of mops and more particularly, to the field of deck mops. More particularly, the present invention relates to the field of manufacturing and assembly of deck mops.

2. Description of the Prior Art

In general, deck mops are well known in the prior art. One major component of a deck mop is the mop yarn which is attached to a mechanism through which the mop yarn is attached to a handle.

In general, the mop yarn is sewn together and thereafter is fastened to a handle by means of having a wire wrapped around the upper portion of the yarn so that it is fastened to the handle which is in simple terms a cylindrical stick made of wood or plastic. Alternatively, the mop yarn is sewn together and then retained by a plastic cup by which the yarn is attached to the handle.

The various apparatus for retaining the mop yarn together and attaching the mop yarn to the handle as known in the prior art involves a time consuming, labor intensive, inefficient manufacturing and assembly process. There is a significant need for a new and improved apparatus for assembling yarn for a deck mop and connecting the yarn to the handle.

SUMMARY OF THE INVENTION

The present invention is a novel, new and improved attachment collar for a deck mop, by which mop yarn can be quickly and efficiently attached together and by which the collar can be quickly and efficiently attached to a handle.

It has been discovered, according to the present invention, that if a collar is molded out of two separate half hemisphere sections connected by a strap, then mop yarn can be laid across the strap section and the half hemispheres brought together and sealed so that the upper middle portion of the yarn is entrapped within the fully formed hemisphere. Thereafter, the hemisphere serves as a collar to retain the mop yarn in fully operational condition.

It has further been discovered, according to the present invention, that if a half sleeve is molded into the top portion of each half hemisphere, with threads molded into the semi-cylindrical interior of each half sleeve, then when the half hemispheres are brought together to retain the mop yarn, the half sleeves are also brought together to form an integrated fully formed sleeve with a cylindrical interior and internal threads through which a handle is attached to the collar.

It has also been discovered, according to the present invention, that if mating fastener means are formed into the half sleeves, then upon being brought together, the half sleeves serve to retain the collar together.

It has additionally been discovered, according to the present invention, that after the half sleeves are brought together and retain the half hemispheres into a fully formed hemisphere, the half hemispheres can also be permanently affixed together to the full hemisphere by means such as sonic welding.

It has additionally been discovered, according to the present invention, that if fastener pins are molded into the interior of the collar such as within the half hemispheres and/or along the connecting strap, then upon formation of the fully formed hemisphere, the fastener pins further serve to securely retain the mop yarn within the fully formed collar and further interlock to retain the fully formed collar in a more secured formed position.

It has further been discovered, according to the present invention, that if a nipple is molded into the interior cylindrical wall of the sleeve and molded into the location of the interior cylindrical wall above the internal threads, then when the threaded end of the handle is screwed into the threads of the sleeve, and if a ratchet section with ratchet teeth are molded into the end of the handle at the location immediately above the threads, then the ratchet teeth will interlock with the molded nipple in the cylindrical wall of the sleeve so that the handle remains in the cylindrical wall of the sleeve of the collar and will not unscrew during use of the mop.

It is therefore an object of the present invention to create a new and improved collar wherein mop yarn which is located on a spool can be quickly unwound from the spool and cut to the appropriate length and laid within the collar and by which the collar can be quickly assembled together to retain the mop yarn therein in a quick and efficient manner.

It is a further object of the present invention to create a new and improved collar which has molded into it a sleeve with a cylindrical interior and having internal threads and a nipple member which can accommodate a threaded end of a mop handle and retain the handle in a manner so that it will not become unscrewed when the mop is in use.

It is a further object of the present invention to create means by which the halves of the collar which entrap the mop yarn can be quickly attached together and fastened together in a quick assembly process.

It is a further object of the present invention to provide further means within the collar by which the mop yarn of the mop can be secured and by which the collar can be further interlocked by the means which serve to secure the mop yarn.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
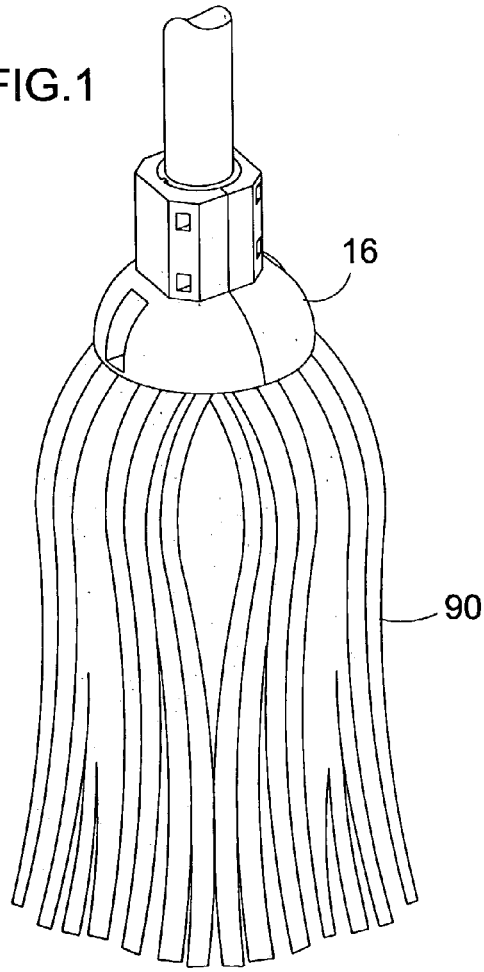
FIG. 1 is a perspective view of the fully assembled deck mop of the present invention, with the mop yarn retained by the new and improved collar of the present invention, which collar in turn is attached to the mop handle.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 3 through 6, the present invention comprises a one-piece collar 10, preferably molded from a single piece of plastic. The collar is formed of a first half hemisphere 20 and a second half hemisphere 30 which are connected together by an attachment strap 40 which connects the lower portion of the half hemispheres and extends from the open bottom of the fully formed hemisphere when the two half hemispheres 20 and 30 are brought together. Molded into the top of first half hemisphere 20 is a first half sleeve 22 having a semi-cylindrical interior wall 23 having internal threads 24. Molded into the top of second half hemisphere 30 is a second half sleeve 32 having a semi-cylindrical interior wall 29 having internal threads 34.

Figure 3:
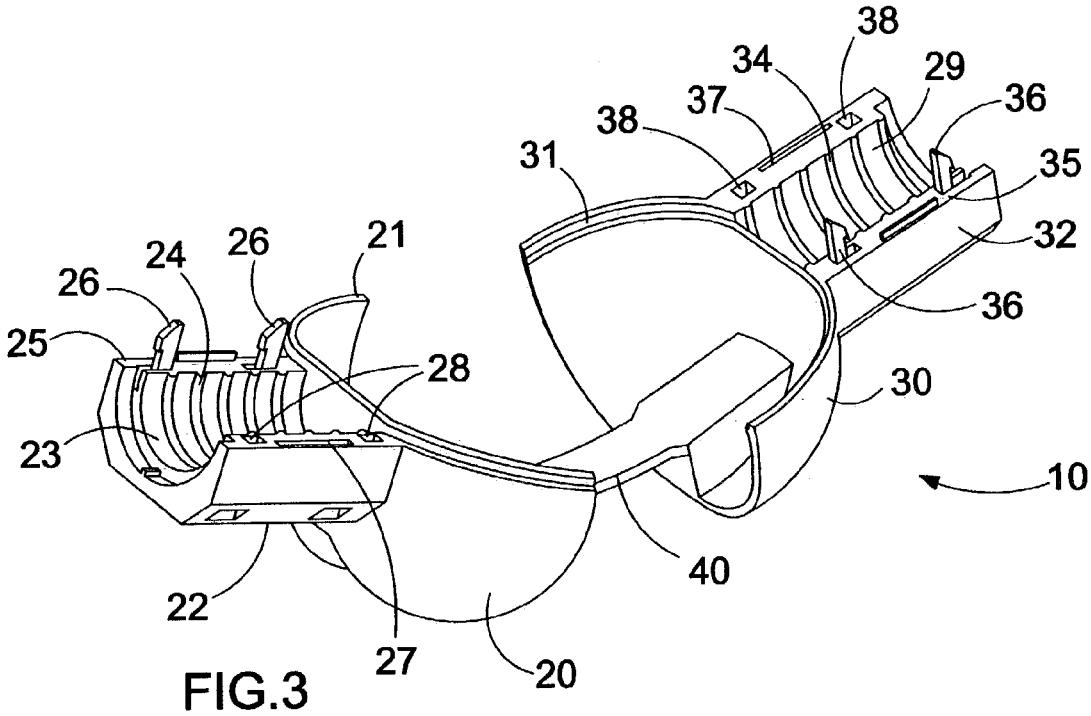
FIG. 3 is an open perspective view of one embodiment of the present invention collar, illustrating a first closure means.

When the halves of the collar are brought together to form a full hemisphere, a full sleeve is also formed from the two halves 22 and 32 and full internal cylinder having full internal threads are formed from the two semi-cylindrical walls 23 and 29 and two half thread sections 24 and 34. Fastener means are used to retain the half sections of the sleeve together. By way of example, male teeth 26 can be molded into one-half of the interior wall 25 of first half sleeve 22 and female receiving members 28 can be molded into the opposite interior wall 27 of first half sleeve 22. Similarly, male teeth 36 can be molded into one-half of the interior wall 35 of second half sleeve 22 and female receiving members 38 can be molded into the opposite interior wall 37 of second half sleeve 32. As illustrated in FIG. 3, the male teeth and female receiving members are aligned so that they interlock and hold the collar together when the two halves are brought together. The two half-hemispheres 20 and 30 can be sonic welded at the location of their joining interior sidewalls 21 and 31.

Figure 6:
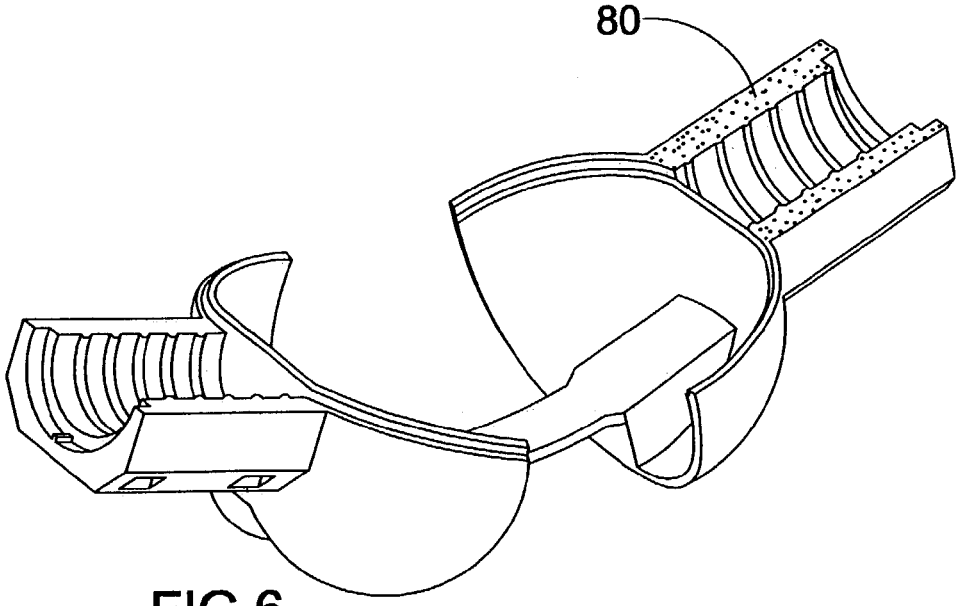
FIG. 6 is an open perspective view of a second embodiment of the present invention collar.

Alternatively, as illustrated in FIG. 6, adhesive 80 can be applied to the interior walls 35 and 37 and also to interior walls 25 and 27 if desired to seal the two half sleeves 22 and 23 together. Adhesive can also be applied to the interior sidewalls 21 and 31 of the half hemispheres if desired.

Figure 4:
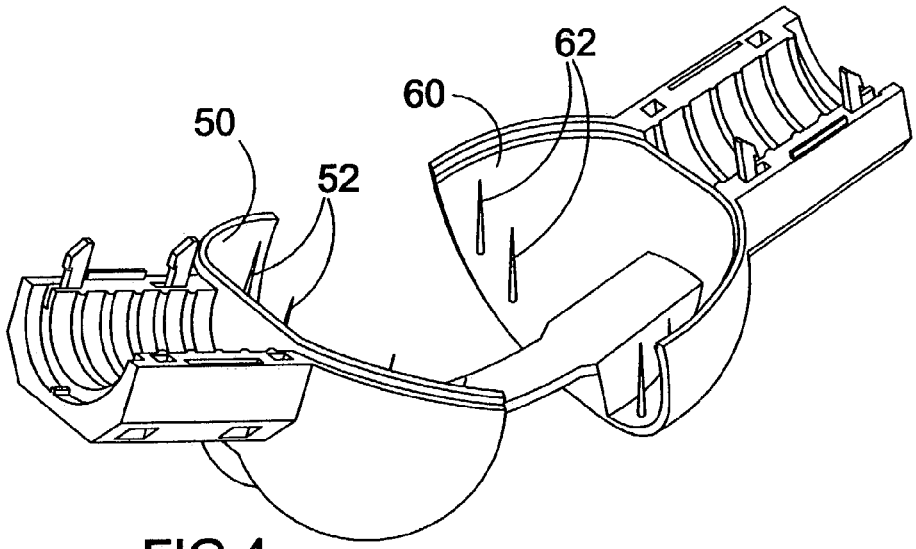
FIG. 4 is an open perspective view of the first embodiment of the present invention collar with the addition of mop yarn fastener pins in the collar half hemispheres.

In one alternative embodiment illustrated in FIG. 4, a first set of fastener pins 52 can be molded into interior face 50 of first half hemisphere 20 and a second set of fastener pins 62 can be molded into interior face 60 of second half hemisphere 30. Fastener pins 52 and 62 extend away from their respective interior faces 50 and 60 and are offset from each other so that the fastener pins 52 and 62 extend toward the center of the fully formed hemisphere when the two half hemispheres 20 and 30 are brought together.

Figure 5:
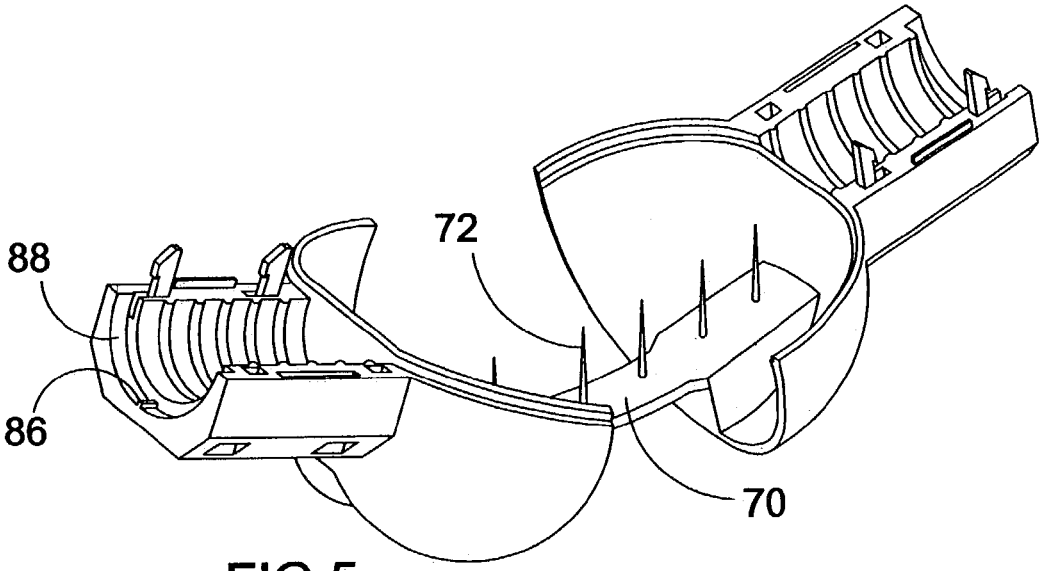
FIG. 5 is an open perspective view of the first embodiment of the present invention collar with the addition of mop yarn fastener pins on the attachment strap which connects the collar half hemispheres.

In another alternative embodiment illustrated in FIG. 5, a third series of fastener pins 72 can be molded into the interior face 70 of attachment strap section 40 and extend along the entire length of attachment strap 40 including the portions that extend into the half hemispheres. The pins 72 are aligned so that they extend toward the center of the fully formed hemisphere when the two half hemispheres are brought together.

Figure 2:
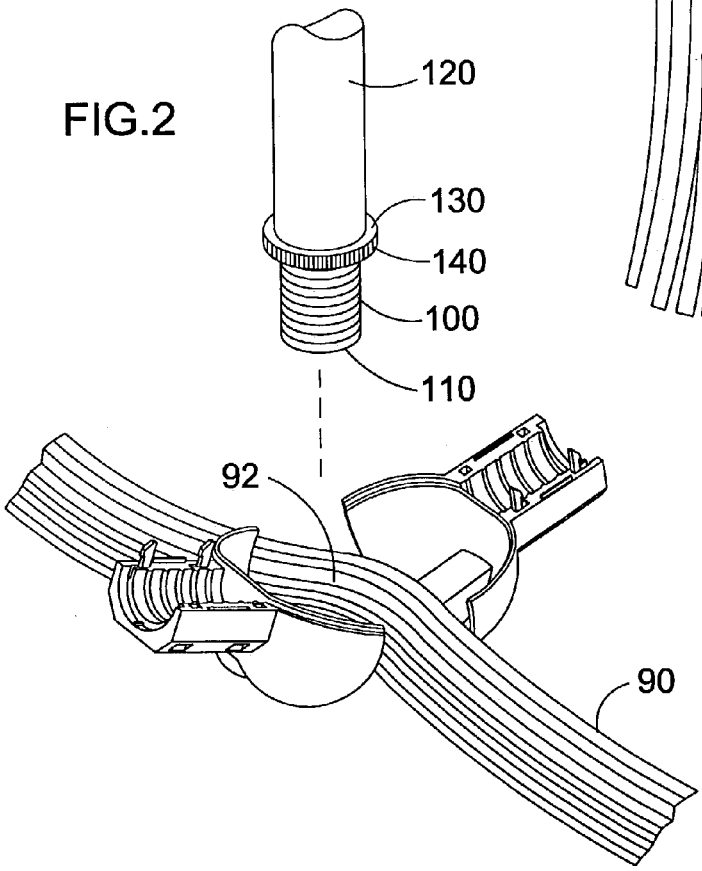
FIG. 2 is a perspective view of a strand of mop yarn inserted into one embodiment of the collar of the present invention with the collar in the open condition before assembly, with the lower portion of the handle shown before insertion into the collar.

The strands of mop yarn are wound on a large spool and therefore, during the assembly process, the mop yarn 90 is unwound from a spool and cut to the desired length. The open collar 10 is positioned to be aligned with the spool of mop yarn so that the appropriately cut length of mop yarn is laid over the interior face 70 of attachment strap 40 as illustrated in FIG. 2. The length of mop yarn 90 is positioned to be centered on the attachment strap 40 so that an equal length of mop yarn extends on either side of the attachment strap 40, as illustrated in FIG. 2.

After the mop yarn 90 is laid across the attachment strap 40, the two half hemispheres 20 and 30 and the two half cylindrical sleeves 22 and 32 are brought together and attached together in the manner previously described so that the center portion 92 of the mop yarn 90 is trapped within the fully formed hemisphere 16 created by the two half hemispheres 20 and 30. The center 92 of the strand of mop yarn 90 then lies over the attachment strap 40 and the mop yarn 90 evenly hangs down from the hemisphere 16 as illustrated in FIG. 1.

If fastener pins 52 and 62 are used, the fastener pins 52 and 62 are embedded into the strands of mop yarn 90 to trap the mop yarn within the fully formed hemisphere 16 and to further secure the mop yarn 90 into the hemisphere 16. If fastener pins 72 are used, the fastener pins 72 are embedded into the strands of mop yarn 90 to trap the mop yarn within the fully formed hemisphere 16 and to further secure the mop yarn 90 into the hemisphere 16.

Figure 7:
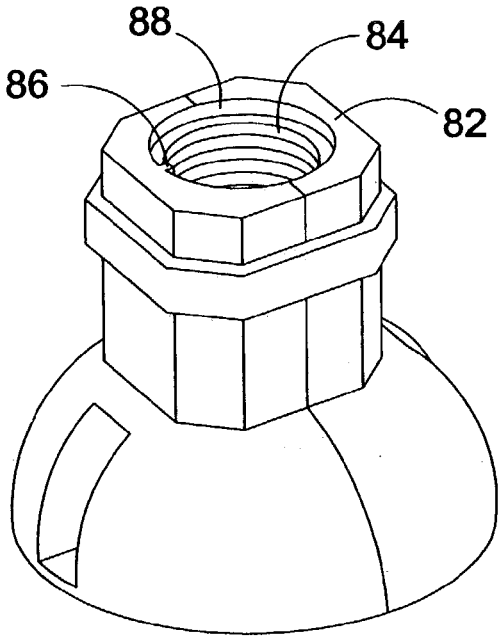
FIG. 7 is a perspective view of an assembled collar without retaining mop yarn and before insertion of the mop handle.

As illustrated in FIG. 7, after the two halves are brought together to form the fully formed collar 10, first half sleeve 22 and second half sleeve 32 form a full sleeve 82 and internal half threads 24 and 34 form a full set of interior threads 84.

Figure 8:
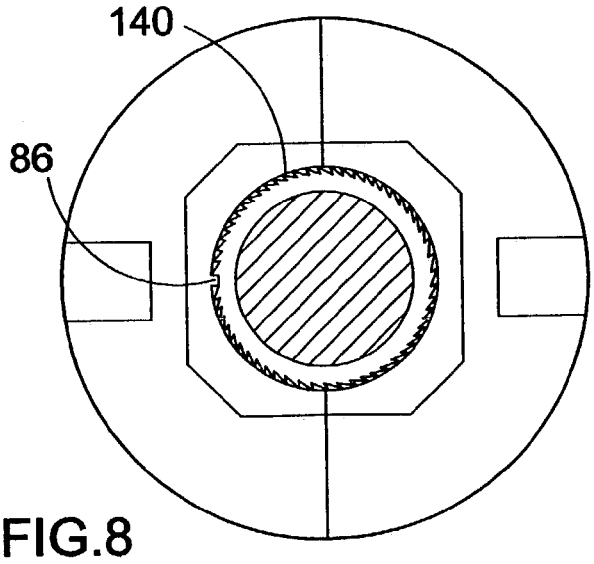
FIG. 8 is a partial cross-sectional top plan view of the collar as illustrated in FIG. 7, with a portion of the handle inserted into the collar.

An additional innovation is the molding of a nipple 86 into the upper interior wall 88 of the fully formed sleeve 82 above the location of the fully formed threads 84. The mop handle 120 has a lower portion 110 having exterior threads 100 which are designed to be accommodated by and threaded into the fully formed threads 84 of fully formed sleeve 82. Immediately above threads 100 is a ratchet section 130 having ratchet teeth 140, which ratchet section and teeth surround the mop handle 120. After the mop handle threads 100 are fully threaded into the sleeve teeth 84, the handle 120 is further rotated until the nipple 86 interlocks with the ratchet teeth 140 as illustrated in FIG. 8. Once interlocked, the mop handle 120 cannot be unthreaded from the collar 10. This is a significant improvement because it has frequently been encountered in use with prior art mops that as the handle is rotated during mopping, the handle unthreads from the section of the mop into which it has been threaded. With the interlock nipple and ratchet teeth, the handle will not unlock from the collar regardless of how vigorous the mopping action is.

The entire collar assembly including all of the components mentioned above as part of the collar can be molded in one single operation and can be molded out of plastic, or any conventional synthetic material such as polyethylene, polypropylene etc. Although not preferred, it is also possible to make the collar out of metal.

Defined in detail, the present invention is a collar to retain mop yarn and attach to a mop handle having exterior threads adjacent one end comprising: (a) a first section comprising a first half hemisphere having a first lower wall, a first interior face, a first interior side, a top having a first half sleeve with a semi-cylindrical interior wall having internal threads, the first half sleeve having a first interior wall containing male teeth and a second interior wall containing female receiving members; (b) a second section comprising a second half hemisphere having a second lower wall, a second interior face, a second interior side, a top having a second half sleeve with a semi-cylindrical interior wall having internal threads, the second half sleeve having a first interior wall containing female receiving members and a second interior wall containing male teeth; (c) a flexible strap member interconnecting the first section and the second section and extending from the interior face of the first half hemisphere to the interior face of the second half hemisphere; and (d) the first section and the second section being movable toward each other by rotation of the two sections together as the flexible strap is bent in a direction away from the interior faces of the half hemisphere such that when the first and second interior sides of the half hemisphere touch a full hemisphere is formed from the first half hemisphere and the second half hemisphere and a full sleeve is formed from the first half sleeve and the second half sleeve, which full sleeve forms a cylindrical interior wall having mating threaded sections from each half sleeve to form full threads on the interior cylindrical wall, the male teeth on the first interior wall of the first half sleeve aligned with the female receiving members on the first interior wall of the second half sleeve and the male teeth on the second interior wall of the second half sleeve aligned with the female receiving members on the second interior wall of the first half sleeve; (e) whereby mop yarn is laid over the flexible strap between the first and second half hemispheres, and when the first and second sections are brought together, the central portion of the mop yarn at the location of the flexible strap is trapped within the fully formed hemisphere while the male teeth and female receiving members serve to retain the first and second sections together to form a full collar, the mop yarn hangs down below the formal hemisphere, and the fully formed threads on the interior cylindrical wall of the sleeve receive the threads of the mop handle.

Defined broadly, the present invention is a collar to retain mop yarn and attach to a mop handle having exterior threads adjacent one end comprising: (a) a first section comprising a first half hemisphere having a first lower wall, a first interior face, a first interior side, a top having a first half sleeve with a semi-cylindrical interior wall having internal threads, the first half sleeve having internal threads, the first half sleeve having interior walls having fastener means; (b) a second section comprising a second half hemisphere having a second lower wall, a second interior face, a second interior side, a top having a second half sleeve with a semi-cylindrical interior wall having internal threads, the second half sleeve having fastener means; (c) a flexible strap member interconnecting the first section and the second section at a location adjacent the first lower wall of the first half hemisphere and the second lower wall of the second half hemisphere; and (d) the first section and the second section being movable toward each other by rotation of the two sections together as the flexible strap is bent in a direction away from the interior faces of the half hemisphere such that when the first and second interior sides of the half hemisphere touch a full hemisphere is formed from the first half hemisphere and the second half hemisphere and a full sleeve is formed from the first half sleeve and the second half sleeve, which full sleeve forms a cylindrical interior wall having mating threaded sections from each half sleeve to form full threads on the interior cylindrical wall and the fastener means on the first half sleeve and the second half sleeve retain the first and second sections together; (e) whereby mop yarn is laid over the flexible strap between the first and second half hemispheres, and when the first and second sections are brought together, the central portion of the mop yarn at the location of the flexible strap is trapped within the fully formed hemisphere while the fastener means retain the first and second half sections together to form the collar, the mop yarn hangs down below the formed hemisphere, and the fully formed threads on the interior cylindrical wall of the sleeve receive the threads of the mop handle.

Defined more broadly, the present invention is a collar to retain mop yarn and attach to a mop handling having exterior threads adjacent one end, comprising: (a) a first section comprising a first half hemisphere including a top having a first half sleeve with an interior wall having threads; (b) a second section comprising a mating second half hemisphere including a top having a mating second half sleeve with an interior wall having threads; (c) a flexible strap member interconnecting the first section and the second section at the location of the first and second half hemispheres; (d) means to retain the first section and the second section together; and (e) the first section and the second section being movable toward each other by rotation of the two sections together as the flexible strap is bent in a direction away from the half hemispheres such that a full hemisphere and a full sleeve is formed from the two sections when they are retained together, and full interior threads are formed in the full sleeve; (f) whereby mop yarn is laid over the flexible strap between the first and second half hemispheres, and when the first and second sections are brought together, the central portion of the mop yarn at the location of the flexible strap is trapped within the fully formed hemisphere, the mop yarn hangs down below the formal hemisphere, and the fully formed threads in the sleeve receive the threads of the mop handle.

Defined alternatively, the present invention is an apparatus to prevent a mop handle from disengaging from a collar retaining mop yarn comprising: (a) a mop handle having exterior threads adjacent one end and a ratchet section having exterior ratchet teeth surrounding the mop handle at a location adjacent the exterior threads farthest from the end of the mop handle; and (b) the collar having means to retain the mop yarn and having a sleeve comprising an internal wall having threads to receive the exterior threads of the mop handle, a nipple formed in the internal wall of the sleeve at a location above the uppermost internal thread; (c) whereby when the exterior threads of the mop handle are threaded into the threads on the sleeve, the nipple interlocks with the ratchet teeth to thereby prevent the mop handle from being removed from the collar.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A collar to retain mop yarn and attach to a mop handle having exterior threads adjacent one end comprising:

a. a first section comprising a first half hemisphere having a first lower wall, a first interior face, a first interior side, a top having a first half sleeve with a semi-cylindrical interior wall having internal threads, the first half sleeve having a first interior wall containing male teeth and a second interior wall containing female receiving members;

b. a second section comprising a second half hemisphere having a second lower wall, a second interior face, a second interior side, a top having a second half sleeve with a semi-cylindrical interior wall having internal threads, the second half sleeve having a first interior wall containing female receiving members and a second interior wall containing male teeth;

c. a flexible strap member interconnecting the first section and the second section and extending from the interior face of the first half hemisphere to the interior face of the second half hemisphere; and d. the first section and the second section being movable toward each other by rotation of the two sections together as the flexible strap is bent in a direction away from the interior faces of the half hemisphere such that when the first and second interior sides of the half hemisphere touch a full hemisphere is formed from the first half hemisphere and the second half hemisphere and a full sleeve is formed from the first half sleeve and the second half sleeve, which full sleeve forms a cylindrical interior wall having mating threaded sections from each half sleeve to form full threads on the interior cylindrical wall, the male teeth on the first interior wall of the first half sleeve aligned with the female receiving members on the first interior wall of the second half sleeve and the male teeth on the second interior wall of the second half sleeve aligned with the female receiving members on the second interior wall of the first half sleeve;

e. whereby mop yarn is laid over the flexible strap between the first and second half hemispheres, and when the first and second sections are brought together, the central portion of the mop yarn at the location of the flexible strap is trapped within the fully formed hemisphere while the male teeth and female receiving members serve to retain the first and second sections together to form a full collar, the mop yarn hangs down below the full hemisphere, and the fully formed threads on the interior cylindrical wall of the sleeve receive the threads of the mop handle.

2. The collar as defined in claim 1, further comprising:

a. a first set of fastener pins on the first interior face of the first half hemisphere, the fastener pins extending away from the first interior face; and b. a second set of fastener pins on the second interior face of the second half hemisphere, the fastener pins extend away from the second interior face;

c. whereby, when the collar is formed, the first and second set of fastener pins are embedded into the mop yarn.

3. The collar as defined in claim 2, wherein the first set of fastener pins are offset from the second set of fastener pins.

4. The collar as defined in claim 1, further comprising:

a. a set of fastener pins on said flexible strap, the fastener pins extending toward the first and second interior faces of the first and second half hemispheres when the full hemisphere is formed;

b. whereby, when the collar is formed, the fastener pins are embedded into the mop yarn.

5. The collar as defined in claim 1, wherein after the collar is formed, the first half hemisphere and the second half hemisphere are attached together by sonic welding at the location of the first interior side and the second interior side.

6. The collar as defined in claim 1, wherein as the collar is formed, the first half hemisphere and the second half hemisphere are attached together by attachment means at the location of the first interior side and the second interior side.

7. The collar as defined in claim 6, wherein the attachment means comprises adhesive attached to at least one of the two interior sides.

8. The collar and mop handle as defined in claim 1 further comprising:

a. a nipple formed into the upper interior cylindrical wall of the sleeve at a location above the uppermost thread; and b. a ratchet section having exterior ratchet teeth surrounding the mop handle at a location adjacent the exterior threads farthest from the end of the mop handle;

c. whereby, when the exterior threads of the mop handle are threaded into the threads on the interior cylindrical wall of the sleeve, the nipple interlocks with the ratchet teeth to thereby prevent the mop handle from being removed from the collar.

9. A collar to retain mop yarn and attach to a mop handle having exterior threads adjacent one end comprising:

a. a first section comprising a first half hemisphere having a first lower wall, a first interior face, a first interior side, a top having a first half sleeve with a semi-cylindrical interior wall having internal threads, the first half sleeve having internal threads, the first half sleeve having interior walls having fastener means;

b. a second section comprising a second half hemisphere having a second lower wall, a second interior face, a second interior side, a top having a second half sleeve with a semi-cylindrical interior wall having internal threads, the second half sleeve having fastener means;

c. a flexible strap member interconnecting the first section and the second section at a location adjacent the first lower wall of the first half hemisphere and the second lower wall of the second half hemisphere; and d. the first section and the second section being movable toward each other by rotation of the two sections together as the flexible strap is bent in a direction away from the interior faces of the half hemisphere such that when the first and second interior sides of the half hemisphere touch a full hemisphere is formed from the first half hemisphere and the second half hemisphere and a full sleeve is formed from the first half sleeve and the second half sleeve, which full sleeve forms a cylindrical interior wall having mating threaded sections from each half sleeve to form full threads on the interior cylindrical wall and the fastener means on the first half sleeve and the second half sleeve retain the first and second sections together;

e. whereby mop yarn is laid over the flexible strap between the first and second half hemispheres, and when the first and second sections are brought together, the central portion of the mop yarn at the location of the flexible strap is trapped within the fully formed hemisphere while the fastener means retain the first and second half sections together to form the collar, the mop yarn hangs down below the formed hemisphere, and the fully formed threads on the interior cylindrical wall of the sleeve receive the threads of the mop handle.

10. The collar as defined in claim 9, wherein said fastener means comprises mating male teeth and female receiving members located on the interior walls of the first half sleeve and the second half sleeve.

11. The collar as defined in claim 9, wherein said fastener means comprises adhesive located on at least one interior wall of one of the half sleeves.

12. The collar as defined in claim 9, wherein as the collar is formed, the first half hemisphere and the second half hemisphere are attached together by attachment means at the location of the first interior side and the second interior side.

13. The collar as defined in claim 12, wherein the attachment means comprises adhesive attached to at least one of the two interior sides.

14. The collar as defined in claim 9, wherein after the collar is formed, the first half hemisphere and the second half hemisphere are attached together by sonic welding at the location of the first interior side and the second interior side.

15. The collar as defined in claim 9, further comprising:

a. a first set of fastener pins on the first interior face of the first half hemisphere, the fastener pins extending away from the first interior face; and b. a second set of fastener pins on the second interior face of the second half hemisphere, the fastener pins extending away from the second interior face;

c. whereby when the collar is formed, the first and second set of fastener pins are embedded into the mop yarn.

16. The collar as defined in claim 15, wherein the first set of fastener pins are offset from the second set of fastener pins.

17. The collar as defined in claim 9, further comprising:

a. A set of fastener pins on at least one of the interior faces of the first or second half hemisphere, the fastener pins extending away from the interior face on which the fastener pins are located;

b. whereby when the collar is formed, the set of fastener pins are embedded into the mop yarn.

18. The collar as defined in claim 9, further comprising:

a. a set of fastener pins on said flexible strap, the fastener pins extending toward the first and second interior faces of the first and second half hemispheres when the full hemisphere is formed;

b. whereby, when the collar is formed, the fastener pins are embedded into the mop yarn.

19. The collar and mop handle as defined in claim 9, further comprising:

a. a nipple formed into the upper interior cylindrical wall of the sleeve at a location above the uppermost thread; and b. a ratchet section having exterior ratchet teeth surrounding the mop handle at a location adjacent the interior threads furthest from the end of the mop handle;

c. whereby, when the exterior threads of the mop handle are threaded into the threads on the interior cylindrical wall of the sleeve, the nipple interlocks with the ratchet teeth to thereby prevent the mop handle from being removed from the collar.

20. A collar to retain mop yarn and attach to a mop handling having exterior threads adjacent one end, comprising:

a. a first section comprising a first half hemisphere including a top having a first half sleeve with an interior wall having threads;

b. a second section comprising a mating second half hemisphere including a top having a mating second half sleeve with an interior wall having threads;

c. a flexible strap member interconnecting the first section and the second section at the location of the first and second half hemispheres;

d. means to retain the first section and the second section together; and e. the first section and the second section being movable toward each other by rotation of the two sections together as the flexible strap is bent in a direction away from the half hemispheres such that a full hemisphere and a full sleeve is formed from the two sections when they are retained together, and full interior threads are formed in the full sleeve;

f. whereby mop yarn is laid over the flexible strap between the first and second half hemispheres, and when the first and second sections are brought together, the central portion of the mop yarn at the location of the flexible strap is trapped within the fully formed hemisphere, the mop yarn hangs down below the full hemisphere, and the fully formed threads in the sleeve receive the threads of the mop handle.

21. The collar as defined in claim 20, wherein said means to retain the first section and the second section together include mating male teeth and female receiving members located on opposing interior walls of the first and second half sleeves.

22. The collar as defined in claim 20 wherein said means to retain the first section and the second section together include adhesive located on at least one opposing interior wall of the first and second half sleeves.

23. The collar as defined in claim 20, wherein as the collar is formed, the first half hemisphere and the second half hemisphere are held together by fastening means.

24. The collar as defined in claim 23, wherein said fastening means is adhesive located on at least one of said half hemispheres at the location where the two half hemispheres are joined.

25. The collar as defined in claim 23, wherein said fastening means is sonic welding at the location where the two half hemispheres are joined.

26. The collar as defined in claim 20, further comprising:

a. said first half hemisphere having a first interior face and a first set of fastener pins on its first interior face, the fastener pins extending away from the first interior face; and b. said second half hemisphere having a second interior face and a second set of fastener pins on its second interior face, the fastener pins extending away from the second interior face;

c. whereby when the collar is formed, the first and second set of fastener pins are embedded in the mop yarn.

27. The collar as defined in claim 26, wherein the first set of fastener pins are offset from the second set of fastener pins.

28. The collar as defined in claim 20, further comprising:

a. said first half hemisphere and said second half hemisphere each having an interior face, and a set of fastener pins on at least one interior face, the fastener pins extending away from the interior face on which the fastener pins are located;

b. whereby when the collar is formed, the set of fastener pins are embedded into the mop yarn.

29. The collar as defined in claim 20, further comprising:

a. a set of fastener pins on said flexible strap, the fastener pins extending toward the hemisphere when the hemisphere is formed;

b. whereby when the collar is formed, the fastener pins are embedded into the mop yarn.

30. The collar and mop handle as defined in claim 20, further comprising:

a. a nipple formed in said sleeve at a location above the uppermost internal thread; and b. a ratchet section having exterior ratchet teeth surrounding the mop handle at a location adjacent the exterior threads furthest from the end of the mop handle;

c. whereby when the exterior threads of the mop handle are threaded into the threads in the sleeve, the nipple interlocks with the ratchet teeth to thereby prevent the mop handle from being removed from the collar.

* * * * *